US006082264A

United States Patent [19]

Meyer et al.

[11] Patent Number: 6,082,264

[45] Date of Patent: Jul. 4, 2000

[54] CONNECTORS FOR WIRED NETWORKS FOR DETONATORS

[75] Inventors: Erich Nicol Meyer, Gauteng; Pierre Lombard, Radiokop; Oliver David Glenn, Western Cape, all of South Africa

[73] Assignee: Sasol Mining Initiators (Proprietary) Limited, Gauteng, South Africa

[21] Appl. No.: 08/992,004

[22] Filed: Dec. 17, 1997

[30] Foreign Application Priority Data

| | | | |
|---|---|---|---|
| Dec. 19, 1996 | [ZA] | South Africa | 9610683 |
| Aug. 19, 1997 | [ZA] | South Africa | 977434 |

[51] Int. Cl.[7] ..... F42B 3/10; F42C 3/14

[52] U.S. Cl. ..... 102/202.9; 102/202.5; 102/217; 102/322

[58] Field of Search ..... 102/200, 202.5, 102/202.9, 206, 217, 322; 439/282, 505, 578, 592, 606, 668, 669

[56] References Cited

U.S. PATENT DOCUMENTS

| | | | |
|---|---|---|---|
| H113 | 8/1986 | McNeel | 439/282 |
| 3,093,432 | 6/1963 | King | 439/606 |
| 3,291,041 | 12/1966 | Dahl | 102/202.9 |
| 3,500,747 | 3/1970 | Parker . | |
| 3,678,432 | 7/1972 | Bolliver | 439/282 |
| 3,735,705 | 5/1973 | Hudson, Jr. et al. | 102/322 |
| 4,267,567 | 5/1981 | Nygaard et al. | 102/202.5 |
| 4,306,499 | 12/1981 | Holmes | 102/202.9 |
| 4,374,605 | 2/1983 | Bratt . | |
| 4,621,578 | 11/1986 | Vallieres et al. | 102/202.9 |
| 5,214,236 | 5/1993 | Murphy et al. | 102/217 |
| 5,375,524 | 12/1994 | Larson . | |
| 5,377,592 | 1/1995 | Rode et al. | 102/206 |
| 5,595,497 | 1/1997 | Wood | 439/282 |

FOREIGN PATENT DOCUMENTS

| | | | |
|---|---|---|---|
| 0 251 824 | 1/1988 | European Pat. Off. . | |
| 0 386 860 | 9/1990 | European Pat. Off. . | |
| 0 609 485 | 8/1994 | European Pat. Off. . | |
| 0 634 623 | 1/1995 | European Pat. Off. . | |
| 1 095 725 | 12/1960 | Germany . | |
| 40 21 319 | 1/1992 | Germany . | |
| 800037 | 8/1958 | United Kingdom | 439/606 |
| 1111347 | 4/1968 | United Kingdom | 439/592 |
| 2 088 148 | 6/1982 | United Kingdom . | |
| WO 90/01610 | 2/1990 | WIPO . | |

*Primary Examiner*—Harold J. Tudor
*Attorney, Agent, or Firm*—Finnegan, Henderson, Farabow, Garrett & Dunner, L.L.P.

[57] ABSTRACT

There is disclosed and claimed a wired network of electrically operable detonators. The network includes a plurality of wired detonator assemblies each including a detonator. The wired assemblies being connected into the network by connectors 10 each including at least one conductive spigot formation 16 removably receivable in a socket 32 which is at least partially lined with a conductive element 34. In the preferred embodiment each connector 10 includes first and second connector halves 12 and 28. The first and second connector halves each includes a body 14, 30 and part of a commercially available connector. The bodies in use forming a water-tight housing for the mating connector parts.

16 Claims, 5 Drawing Sheets

CONNECTORS FOR WIRED NETWORKS FOR DETONATORS

INTRODUCTION AND BACKGROUND

This invention relates to electronic or electric sequential blasting systems and more particularly to such systems for use in mining operations. The invention relates in particular to connectors for use in systems of the aforementioned kind including wired networks for electronic and electric detonators, hereinafter referred to as electrically operable detonators.

Wired networks for electrically operable detonators include a blast box and insulated electricity conductive leading wires extending from the blast box, the leading wires being connected by connecting means to the blast box. Detonators, each including an insulated conductive umbilical cord, are connected via the cords to the leading wire, by means of connecting means. Insulated conductive extension wires or extension pieces may be provided between the detonators or between sections of the leading wire. These extension wires are also connected to the leading wire by connecting means.

In one known system, the connections are made by in situ removing protective sheathes at bare ends of the umbilical cords of the detonators and twisting the bare ends about bare regions in the leading wire, to make ohmic or galvanic contact. This method of connecting the detonators to the leading wire is laborious, time consuming and the system as such may not be safe and reliable enough.

In another known system, inductive coupling is utilised. A C-shaped magnetic core with a plurality of windings of the detonator umbilical cord wound thereon, is clipped onto the leading wire.

In yet another system a custom made so-called insulation displacement connector (IDC) is used. An IDC includes prongs or teeth capable of piercing the insulation of an embedded conductor to which it is to be connected, to make electrical contact with the conductor. These connectors are cumbersome to use, especially in multi-conductor connections where time and skill are required to ensure that each tooth penetrates to the selected conductor with which contact is required. Furthermore, these connectors are difficult to instal, because they have a preferred orientation relative to the wire to which they are to be connected for best results.

OBJECT OF THE INVENTION

Accordingly it is an object of the present invention to provide an alternative connector for the above purpose and a network, a detonator assembly and a method of producing such connectors with which the applicant believes the aforementioned problems may at least be alleviated.

SUMMARY OF THE INVENTION

According to the invention there is provided a wired network of electrically operable detonators, the network including a plurality of wired detonator assemblies each including a detonator, the wired assemblies being connected into the network by connectors each including at least one conductive spigot formation removably receivable in a socket, the socket being at least partially lined with a conductive element.

A wire connected to the at least one spigot formation preferably terminates in the spigot formation and a wire connected to the conductive element preferably terminates in the conductive element, the conductive element preferably being arranged to clad side walls of the socket, thereby to line the socket.

The connector may be used to connect an umbilical cord of a detonator to a leading wire of the network and/or to connect the leading wire to a blast or control box and/or to connect extension wires between adjacent detonators and/or to connect extension wires into the leading wire.

The connector may include first and second connector halves, the first connector half including a body of an insulating material for holding the at least one spigot formation and the second connector half including a body of an insulating material defining the socket.

The connector may include arresting means for arresting the body of the first connector half and the body of the second connector half when the at least one spigot mates with the lined socket. The arresting means may include complementary threads provided on the body of the first connector half and on the body of the second connector half respectively. In another embodiment the arresting means may include at least one circular rib and a complementary annular groove provided on the body of the first connector half and in the body of the second connector half respectively, alternatively on the body of the second connector half and in the body of the first connector half respectively.

In a preferred embodiment of the invention, the body of the first connector half and the body of the second connector half collectively form a water tight housing for the at least one spigot and the socket when the at least one spigot mates with the socket.

In the most preferred embodiment of the invention the at least one spigot and the socket at least partially lined with a conductive element form part of a commercially available connector. The commercially available connector is preferably any one of a RCA-connector, a jack plug connector, a DIN connector and a BNC connector.

Also included within the scope of the present invention is a connector for use in an electrically operable detonator system, the connector including at least one conductive spigot formation removably receivable in a socket at least partially lined with a conductive element.

A wire connected to the at least one spigot formation preferably terminates in the at least one spigot formation and a wire connected to the conductive element preferably terminates in the conductive element, the conductive element being arranged in the socket to clad side walls of the socket, thereby to line the socket.

The connector may comprise first and second connector halves, the first connector half including a body of an insulating material for holding the at least one spigot formation and the second connector half including a body of an insulating material defining the socket.

The connector may also include means for arresting the body of the first connector half and the body of the second connector half, when the at least one spigot mates with the socket. The means for arresting the body of the first connector half and the body of the second connector half may include complementary threads provided on the body of the first connector half and on the body of the second connector half respectively. Alternatively, the means for arresting the body of the first connector half and the body of the second connector half may include an annular rib on one of the body of the first connector half and the body of the second connector half and a complementary groove provided on another of the body of the first connector half and the body of the second connector half.

In a preferred embodiment, the body of the first connector half and the body of the second connector half collectively form a water tight housing for the at least one spigot and the socket when the at least one spigot mates with the socket.

One of the body of the first connector half and the body of the second connector half may include an integral annular sleeve wherein another of the body of the first connector half and the body of the second connector half is removably receivable when the at least one spigot formation is received in the socket.

In the most preferred embodiment the at least one spigot formation and the socket at least partially lined with a conductive element form part of a commercially available connector. The commercially available connector is preferably any one of a RCA-connector, a jack plug connector, a DIN connector and a BNC connector.

Also included within the scope of the invention is a method of producing a connector for use in wired networks of electrically operable detonators, the method including the steps of:

utilizing a commercially available connector including a first connector formation and a separate second connector formation for cooperating with the first connector formation to make a connection;

providing a first insulating body for the first connector formation and a second insulating body for the second connector formation; and arranging the first body and the second body such that when a connection is made between the first connector formation and the second connector formation, the first and second bodies collectively form a water-tight housing for the connection.

Yet further included within the scope of the present invention is a detonator assembly including:

an electrically operable detonator;

a first cable comprising at least first and second conductors connected at one end thereof to the detonator;

the first cable being connected at another end thereof to a first connector half comprising at least first and second terminals;

a second cable also comprising at least first and second conductors connected at one end thereof to the first connector half;

the second cable being connected at its other end to a second connector half comprising at least first and second terminals and which are complementary to the at least first and second terminals of the first connector half.

Preferably the first and second conductors of the first cable are connected at their one ends to first and second terminals respectively of the detonator; the first and second conductors of the first cable being connected at their other ends to the first and second terminals respectively of the first connector half; the first and second conductors of the second cable being connected at their one ends to the first and second terminals respectively of the first connector half and at their other ends to the first and second terminals respectively if the second connector half, the arrangement being such that when the first connector half and second connector half of the assembly are connected to one another, the first terminal of the first connector half cooperates with the second terminal of the second connector half and the second terminal of the first connector half cooperates with the first terminal of the second connector half, so that there is a short circuit between the first and second terminals of the detonator.

In one embodiment the second connector half may include a jack plug and the first and second terminals of the second connector half may be axially spaced from one another on the plug; the first connector half may define a complementary socket for the plug; and the first and second terminals of the first connector half may be axially spaced within the socket.

In another embodiment the first and second terminals of the first connector half include a spigot and coaxial sleeve of a RCA connector; and the first and second terminals of the second connector half include coaxially mounted outer and hollow inner sleeves of the RCA connector.

An identification code characteristic of the detonator may be stored electronically in electronic circuitry forming part of the detonator and the code may also be provided on an external surface of a body of the first and/or second connector halves in a form, for example bar code format, wherein it is readable by a reader or a form wherein it is discernable by a human.

BRIEF DESCRIPTION OF THE ACCOMPANYING DIAGRAMS

The invention will now further be described, by way of example only, with reference to the accompanying diagrams wherein.

DESCRIPTION OF A PREFERRED EMBODIMENT OF THE INVENTION

Figure 1:
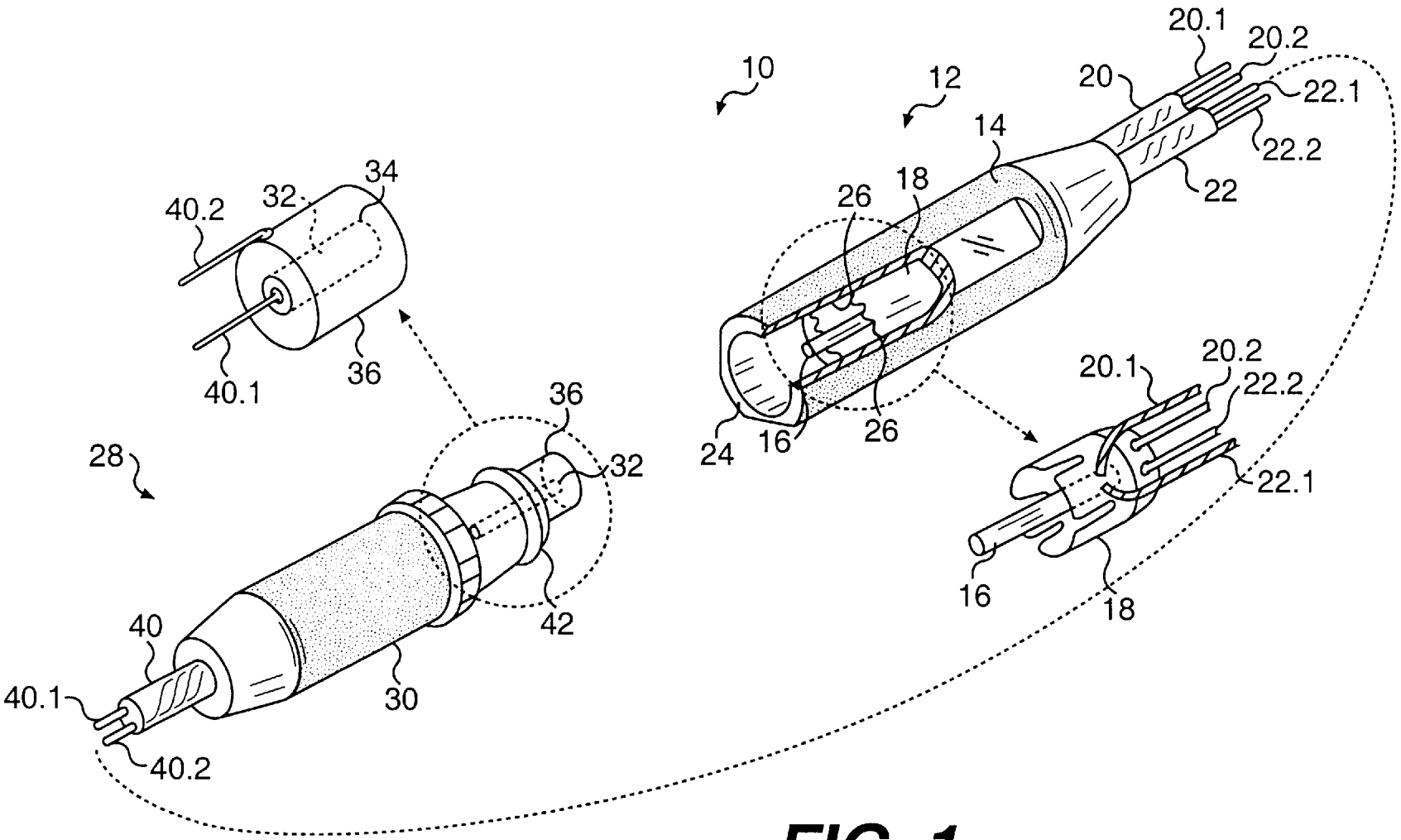
FIG. 1 is a perspective view, partially broken away and enlarged of first and second connector halves of a first embodiment of a connector according to the invention for use in a wired network of electrically operable detonators.
Figure 2:
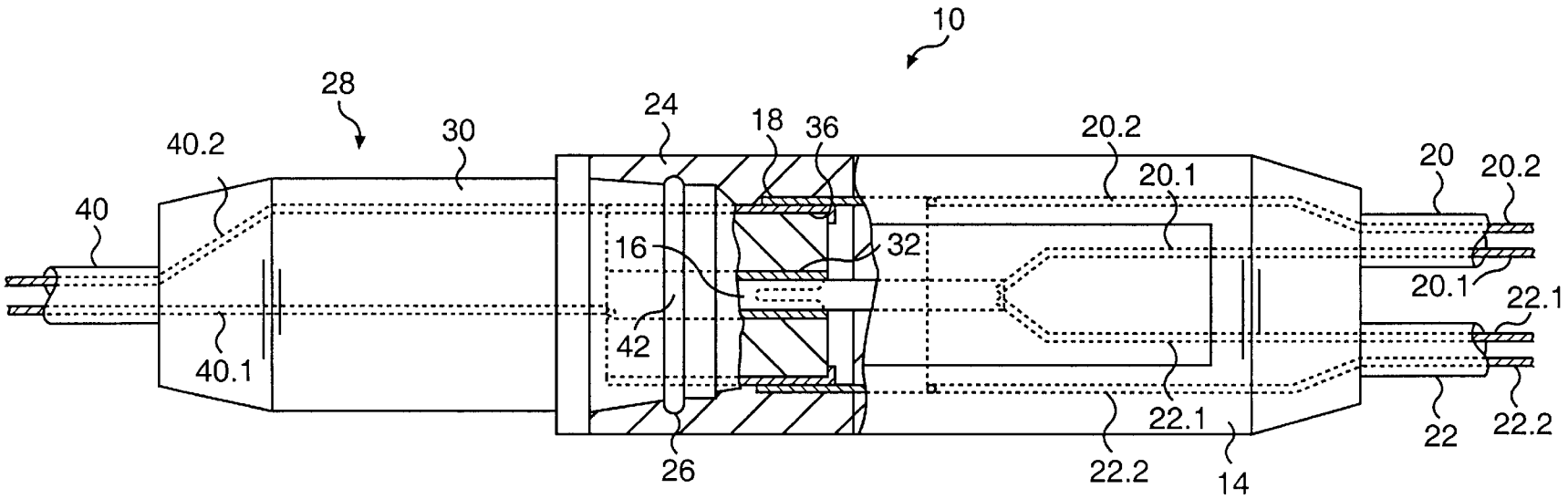
FIG. 2 is a partial longitudinal section through the connector in FIG. 1 wherein one half of the connector is mating with another.

A connector for use in a wired network for electronic or electric detonators is generally designated by the reference numeral 10 in FIGS. 1 and 2.

The connector 10 includes a commercially available RCA connector which is adapted for the purpose aforesaid as described hereinafter. The connector 10 includes a first connector half 12 including a body 14 of an insulating material. The first connector half further includes a conductive spigot 16 and a coaxially mounted tubular conductive terminal 18 forming part of the aforementioned commercially available RCA connector. The first connector half 12 further includes a sleeve 24 of an insulating material which is formed integrally with the insulating body 14. The sleeve 24 extends coaxially with and beyond the spigot 16 and is resiliently flexible. On an inside wall of the sleeve there is defined an annular recess 26.

The connector further includes a second connector half 28 including a body 30 of an insulating material. A unit forming part of the commercially available RCA connector and which unit defines a socket 32 lined with a conductive element 34 and includes a coaxial circular cylindrical conductive terminal 36, is provided on the body 30.

The outside diameter of the spigot 16 is smaller than the inside diameter of the lining 34 and the outside diameter of the terminal 36 is smaller than the inside diameter of the tubular terminal 18, so that the spigot 16 is a tight fit in the lined socket and the terminal 36 is a tight fit in the tubular terminal 18. On the outside of body 30 there is provided an annular rib 42.

To make a connection utilizing connector halves 12 and 28, the front end of the connector half 28 is inserted into sleeve 24. As explained hereinbefore, spigot 16 mates with lined socket 32 and terminal 36 mates with terminal 18. Sleeve 24 extends over and sheathes the front end of the body 30. With the spigot 16 and terminal 36 so received, rib 42 is also received in recess 26 by a positive clip action, to arrest the body 14 and the body 30 together, when the connection is made. The bodies 14 and 30, the sleeve 24 and the cooperating rib 42 and recess 26 collectively form a water-tight housing for the aforementioned mating components.

The connector may be formed by selecting any suitable commercially available connector and by providing it with body parts similar to that described hereinbefore, to form a connector according to the invention, particularly suitable for use in wired networks for detonators.

In use, and as shown in FIGS. 1 and 2 and as will be described hereinafter, first conductors 20.1 and 22.1 of cables 20 and 22 are connected to the spigot 16 and second conductors 20.2 and 22.2 of the cables are connected to tubular terminal 18. Furthermore, conductor 40.1 of cable 40 is connected to the element 34 and conductor 40.2 of the cable 40 is connected to the terminal 36.

Figure 3:
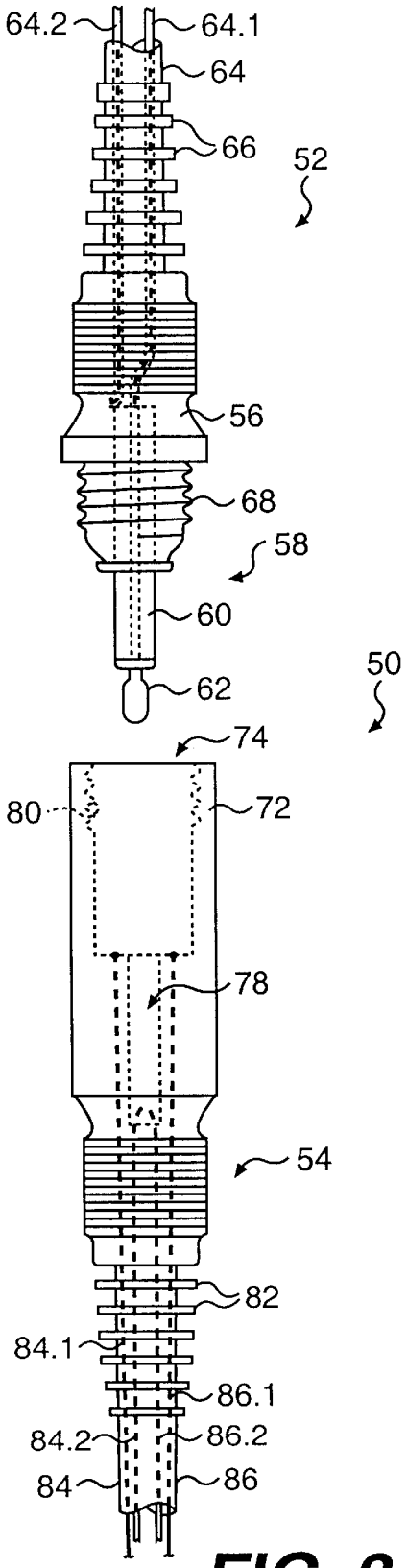
FIG. 3 is an elevational view of first and second connector halves of a second embodiment of the connector according to the invention for use in a wired network of electrically operable detonators.
Figure 4:
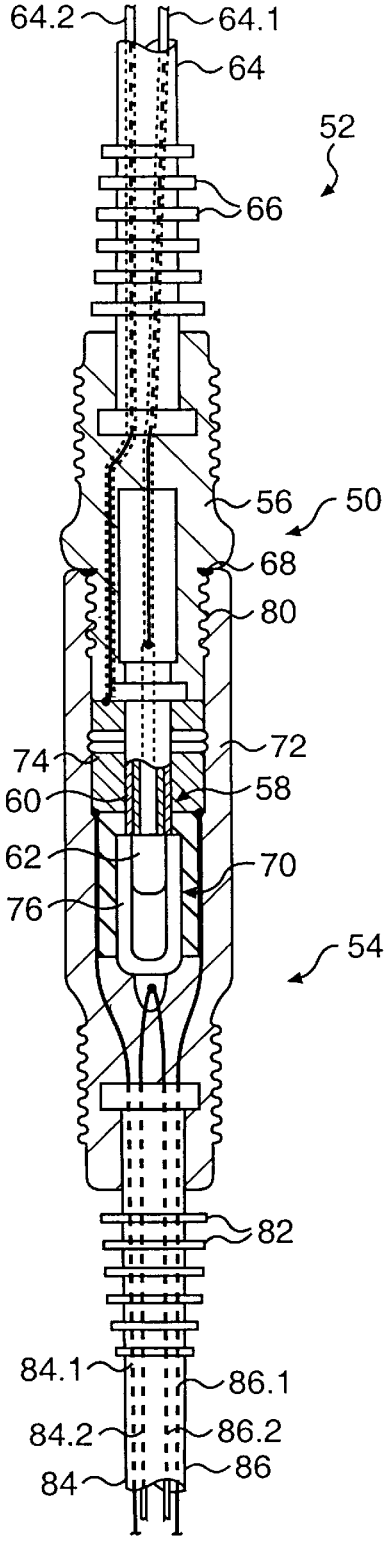
FIG. 4 is a longitudinal section through the connector in FIG. 3 wherein one connector half of the connector is mating with another.

A second embodiment of a connector according to the invention is generally designated by the reference numeral 50 in FIGS. 3 and 4. The connector 50 comprises a first connector half 52 and a second connector half 54. First connector half 52 includes an insulating body 56 and a jack plug part 58 of a commercially available connector including a jack plug and associated socket defining terminal arrangement. The jack plug part 58 provides first and second axially spaced and mutually insulated terminals 60 and 62. In use, conductor 64.1 of cable 64 is connected to terminal 62 and conductor 64.2 of cable 64 is connected to terminal 60. Ribbed formations 66 are provided on body 56 to facilitate handling of the first connector half 52.

Locking means in the form of a first thread 68 is provided on a front end of body 56 adjacent jack plug 58.

The aforementioned socket defining terminal arrangement 70 of the commercially available jack plug connector is located in a body 72 of an insulating material. The body 72 defines a mouth 74 for receiving the front end of the connector half 52. The socket defining terminal arrangement comprises first and second axially spaced terminal elements 74 and 76 lining a socket 78 in body 72 for receiving jack plug 58 and the front end of body 56. In the socket 78 there is provided a second thread 80 for cooperating with the first thread 58 when the jack is received in socket 78, to lock the first connector half to the second connector half. Ribs 82 on the second half 54 facilitate handling of the second connector half. In use, first conductors 84.1 and 86.1 of cables 84 and 86 are connected to the first terminal element 74 and second conductors 84.2 and 86.2 of cables 84 and 86 are connected to the second terminal element 76.

Figure 5:
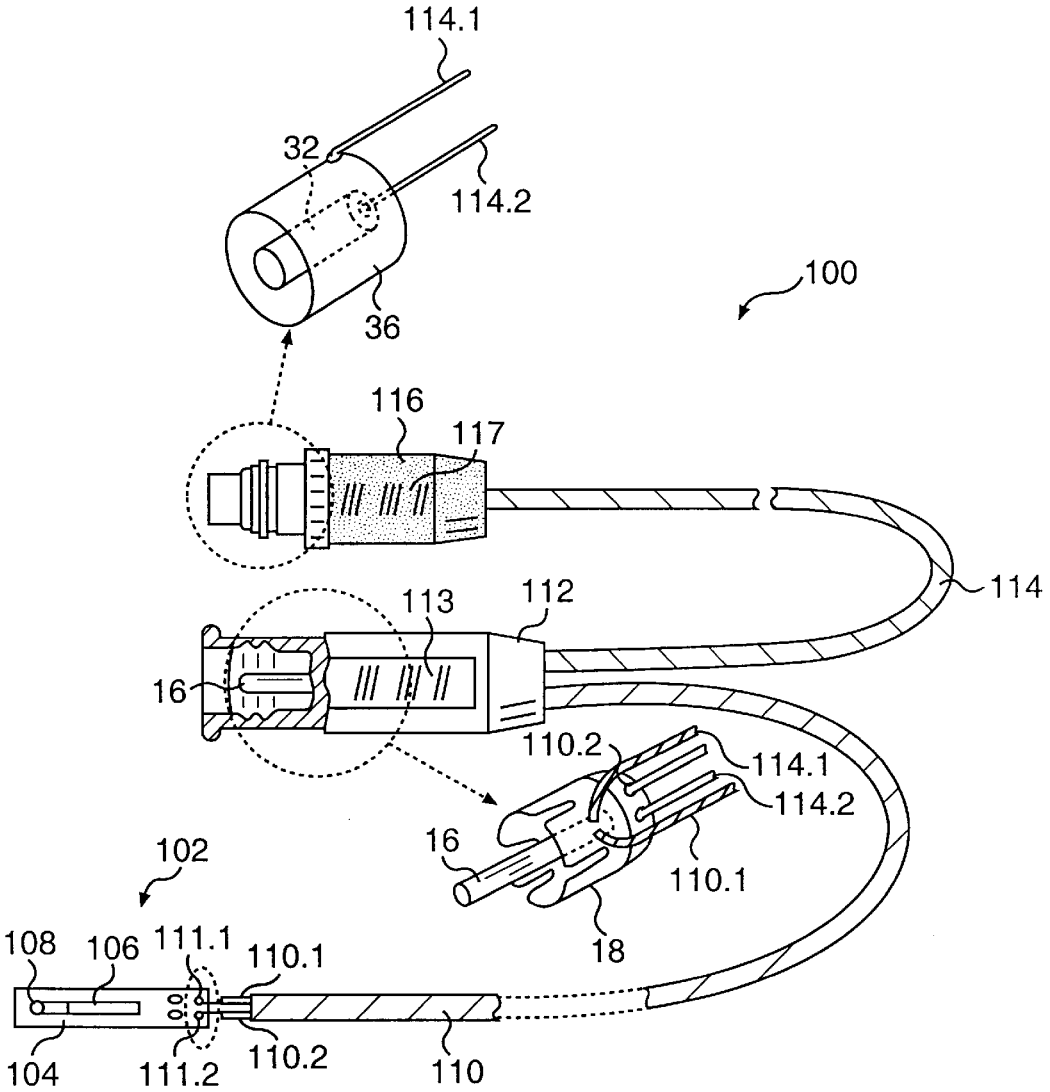
FIG. 5 is a diagrammatic representation of a detonator assembly according to the invention.

In FIG. 5, there is shown a diagrammatic illustration of a detonator assembly 100 according to the invention. The assembly comprises a detonator 102 including a printed circuit board 104 on which electronic circuitry 106 forming part of the detonator is mounted. The circuitry controls the operation of a bridge element 108. A first cable 110 comprising two insulated conductors 110.1 and 110.2 is connected at one end thereof to terminals 111.1 and 111.2 of the detonator arrangement. At the other end of the cable the conductors are connected to connector half 112 which is similar to connector half 12 (shown in FIGS. 1 and 2) in the same way that conductors 20.1 and 20.2 are connected to connector half 12. Thus, conductor 110.1 is connected to the spigot 16 and conductor 110.2 to the tubular terminal 18. A second cable 114 including insulated conductors 114.1 and 114.2 is connected at one end thereof to the terminals of connector half 112 in the same way that conductors 22.1 and 22.2 are connected to connector 12 in FIG. 1 and FIG. 2. Thus, conductor 114.1 is connected to the spigot 16 and conductor 114.2 to the tubular terminal 18. At the other end of cable 114, conductors 114.1 and 114.2 are connected to second connector half 116 which is similar to connector half 28 shown in FIGS. 1 and 2. Conductor 114.1 is connected to the sleeve 36 and conductor 114.2 to the tubular element 34.

Thus, when the first connector half 112 and the second connector half 116 of the same detonator assembly 100 are engaged with one another, the terminals 111.1 and 111.2 of the detonator arrangement 100 are short-circuited, which increases the safety of the arrangement when not in use, for example during storage and transit.

An identification code characteristic of the detonator 102 is electronically stored in a memory arrangement (not shown) of the circuitry 106. The code is used to address the detonators 102 to transmit control signals or delay time data to the detonator from a control box via the wired network. A representation of the code is provided in bar code format on an external surface of the bodies of connector halves 112 and 116, at 113 and 117 respectively. The code may alternatively or in addition be provided in a human discernable form on the body. The fact that the code is also readable otherwise than via the network, facilitates the planning and design of a multi-shot blast utilizing detonator assemblies of the kind described and of the lay-out of the blast site.

In use, a wired network of electrically operable detonators is conveniently formed by mating the first connector half 112 of an assembly 100 with the second connector half 116 of an immediately adjacent assembly. Extension wires may also be connected into the network utilizing connectors as herein described and/or defined. Furthermore, the network may also be connected to a blast box and a terminator utilizing connectors as herein defined and/or described.

Figure 6:
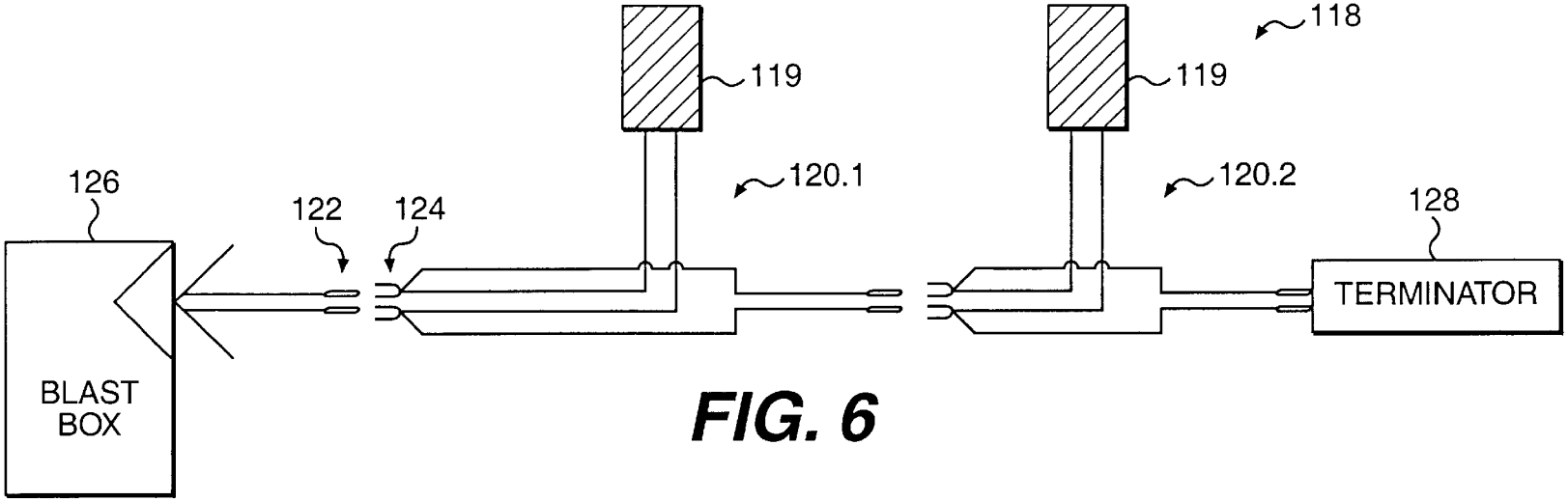
FIG. 6 is a basic diagram illustrating the interconnection of detonator assemblies similar to that of FIG. 5, to form a wired network of electrically operable detonators.

In FIG. 6 there is shown a wired network 118 of electrically operable detonators 119 comprising detonator arrangements 120.1 and 120.2 which are similar to detonator arrangement 100 described hereinbefore.

The only difference between detonator arrangements 120.1 and 120.2 on the one hand and arrangement 100 on the other hand is the configuration of the connectors. In detonator arrangement 100 connectors comprising commercially available RCA connectors are used. In detonator arrangements 120.1 and 120.2 commercially available connectors comprising dual parallel prongs 122 and associated dual parallel socket defining terminal arrangements 124 are utilised. As shown, the connectors according to the invention may also be utilized to connect the network 118 to a blast box 126 and to a terminator 128.

Figure 7:
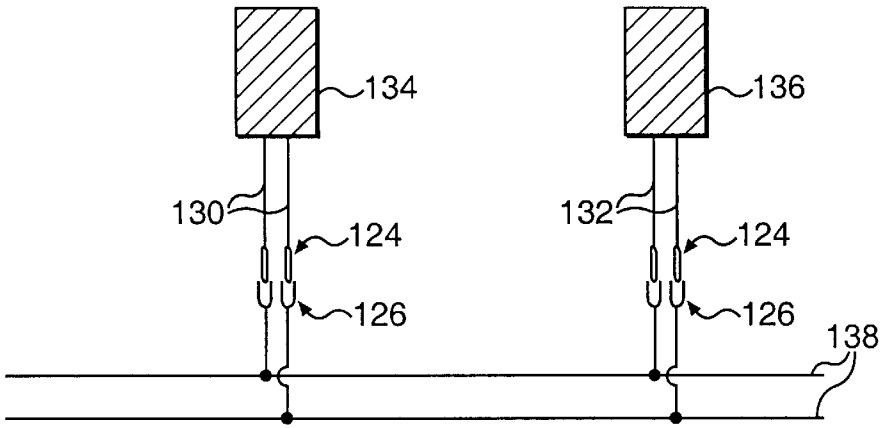
FIG. 7 is a basic diagram of another wired network of electrically operable detonators wherein connectors according to the invention are utilized to form the network.

In FIG. 7 there is shown another network configuration wherein connector halves 122 and 124 according to the invention are utilised to connect the umbilical cords 130 and 132 of detonator assemblies 134 and 136 respectively to a leading wire 138.

It will be appreciated that the connectors according to the invention may be utilised to connect a leading wire to a blast box, to connect extension wires to the leading wire, to connect detonators or detonator assemblies to the leading wire and to connect detonator assemblies to one another.

It will further be appreciated that there are many variations in detail on the network, connector, detonator assembly and method of producing a connector according to the invention without departing from the scope and spirit of the appended claims.

What is claimed is:

1. A wired network of electrically operable mining detonators, the network including a plurality of wired detonator assemblies each including a detonator, a pair of detonator wires connected to the detonator, and a pair of network wires, the detonator wires of the wired assemblies being connected in parallel with the pair of network wires within one part of multi-part connectors, each including at least one conductive spigot formation removably receivable in a socket at least partially lined with a conductive element.

2. A network as claimed in claim 1 wherein a wire connected to the at least one spigot formation terminates in the at least one spigot formation and a wire connected to the conductive element terminates in the conductive element, the conductive element being arranged in the socket to clad side walls of the socket, thereby to line the socket.

3. A network as claimed in claim 1 wherein each multi-part connector comprises first and second connector halves, the first connector half including a body of an insulating material for holding the at least one spigot formation and the second connector half including a body of an insulating material defining the socket.

4. A network as claimed in claim 3 wherein each connector includes means for arresting the body of the first connector half and the body of the second connector half when the at least one spigot mates with the socket.

5. A network as claimed in claim 3 wherein the body of the first connector half and the body of the second connector half collectively form a water tight housing for the at least one spigot and the socket when the at least one spigot mates with the socket.

6. A network as claimed in claim 1 wherein the at least one spigot and the socket at least partially lined with a conductive element form part of a commercially available connector.

7. A network as claimed in claim 6 wherein the commercially available connector is any one of a RCA-connector, a jack plug connector, a DIN connector and a BNC connector.

8. A connector for use in a wired network of electrically operable mining detonators, the wired network including a pair of network conductors and a pair of detonator conductors connected to a detonator, the connector having two parts and including a pair of conductive formations in one part removably receivable by a pair of formations in the other part, the conductive formations including at least one spigot formation and a mating socket formation at least partially lined with a conductive element, the pair of network conductors and the pair of detonator conductors being connected to one of the spigot and socket formations within one of the two parts of the connector, thereby to provide a parallel connection of the detonator conductors to the network conductors within the connector.

9. A connector as claimed in claim 8 wherein the spigot formations and the socket formations at least partially lined with a conductive element are parts of a commercially available connector.

10. A connector as claimed in claim 9 wherein the commercially available connector is any one of a RCA-connector, a jack plug connector, a DIN connector and a BNC connector.

11. A detonator assembly including:

an electrically operable detonator;

a first cable comprising at least first and second conductors connected at one end thereof to the detonator;

the first cable being connected at another end thereof to a first connector half comprising at least first and second terminals;

a second cable also comprising at least first and second conductors connected at one end thereof to the first connector half;

the second cable being connected at its other end to a second connector half comprising at least first and second terminals and which are complementary to the at least first and second terminals of the first connector half.

12. A detonator assembly as claimed in claim 11 wherein the first and second conductors of the first cable are connected at their one ends to first and second terminals respectively of the detonator; wherein the first and second conductors of the first cable are connected at their other ends to the first and second terminals respectively of the first connector half; wherein the first and second conductors of the second cable are connected at their one ends to the first and second terminals respectively of the first connector half and at their other ends to the first and second terminals respectively of the second connector half, and wherein when the first connector half and second connector half of the assembly are connected to one another, the first terminal of the first connector half cooperates with the second terminal of the second connector half and the second terminal of the first connector half cooperates with the first terminal of the second connector half, so that there is a short circuit between the first and second terminals of the detonator.

13. A detonator assembly as claimed in claim 12 wherein the second connector half includes a jack plug, wherein the first and second terminals of the second connector half are axially spaced from one another on the plug; wherein the first connector half defines a complementary socket for the plug; and wherein the first and second terminals of the first connector half are axially spaced within the socket.

14. A detonator assembly as claimed in claim 12 wherein the first and second terminals of the first connector half include a spigot and coaxial sleeve of a RCA connector; and wherein the first and second terminals of the second connector half include coaxially mounted outer and hollow inner sleeves of the RCA connector.

15. A detonator assembly as claimed in claim 11 wherein an identification code characteristic of the detonator is electronically stored in electronic circuitry forming part of the detonator and wherein a representation of the code is provided on a body of the first and/or second connector halves in a form wherein it is readable otherwise than via the cables connected to the detonator.

16. A method for connecting electrically operable mining detonators in a wired network including a pair of network conductors, the method comprising the steps of:

providing a connector having two parts, each part including a pair of commercially available conductive formations, the pair of conductive formations in one part being removably receivable by the pair of conductive formations in the other part, providing each mining detonator with a pair of detonator conductors, and connecting the pair of network conductors and the pair of detonator conductors to the pair of conductive formations within one of the two parts of the connector, thereby to provide a parallel connection of the detonating conductors to the network conductors within the connector.

* * * * *